US006039492A

United States Patent [19]

Chen

[11] Patent Number: 6,039,492

[45] Date of Patent: Mar. 21, 2000

[54] PEN

[76] Inventor: Wei-Chin Chen, 10-3F No. 72, Sec 1, Min-Chuan E. Rd., Taipei, Taiwan

[21] Appl. No.: 09/205,355

[22] Filed: Dec. 4, 1998

[51] Int. Cl.[7] ..... B43K 29/00

[52] U.S. Cl. ..... 401/195; 401/194; 401/52

[58] Field of Search ..... 401/52, 193, 194, 401/195

[56] References Cited

FOREIGN PATENT DOCUMENTS

| | | | |
|---|---|---|---|
| 2653526 | 6/1978 | Germany | 401/195 |
| 2219255 | 12/1989 | United Kingdom | 401/195 |
| WO 96/11115 | 4/1996 | WIPO | 401/195 |

OTHER PUBLICATIONS

Celebrity Pens, Commemorative Signature Pen, class 401, subclass 195.

Musical Pen Organ, class 401, subclass 195, Oct. 5, 1988.

*Primary Examiner*—David J. Walczak
*Assistant Examiner*—Khoa Huynh
*Attorney, Agent, or Firm*—Bacon & Thomas, PLLC

[57] ABSTRACT

A pen body, a head member connected to the pen body, the head member having a recessed receiving chamber and a locating groove for securing a display item in the recessed receiving chamber, and a cover hinged to one lateral side of the head member for covering the recessed receiving chamber.

12 Claims, 5 Drawing Sheets

PEN

BACKGROUND OF THE INVENTION

The present invention relates to writing apparatus, and more particularly to a pen which has a head member covered with a hinged cover for holding a picture or mirror on the inside.

A variety of writing tools including pens, crayons, pastels, charcoals, oil paints, felt tip pens, marking crayons, marker pens, ball-point pens, pencils, automatic pencils, color pens, etc., have been developed for use in different conditions or for different purposes. These writing tools may be marked or printed with advertising words. There are also writing tools with added functions, for example, a light pen has an illuminator attached thereto, a laser pointer pen has a laser point attached thereof.

SUMMARY OF THE INVENTION

According to one aspect of the present invention, the pen comprises a pen body, a head member connected to the pen body at one end remote from the writing tip of the pen body, the head member having a recessed receiving chamber and locating means for securing a picture or mirror in the recessed receiving chamber, and a cover hinged to one lateral side of the head member for covering the recessed receiving chamber. According to another aspect of the present invention, the head member is detachably connected to the pen body by a screw joint.

DETAILED DESCRIPTION OF THE PREFERRED EMBODIMENT

Figure 1A:
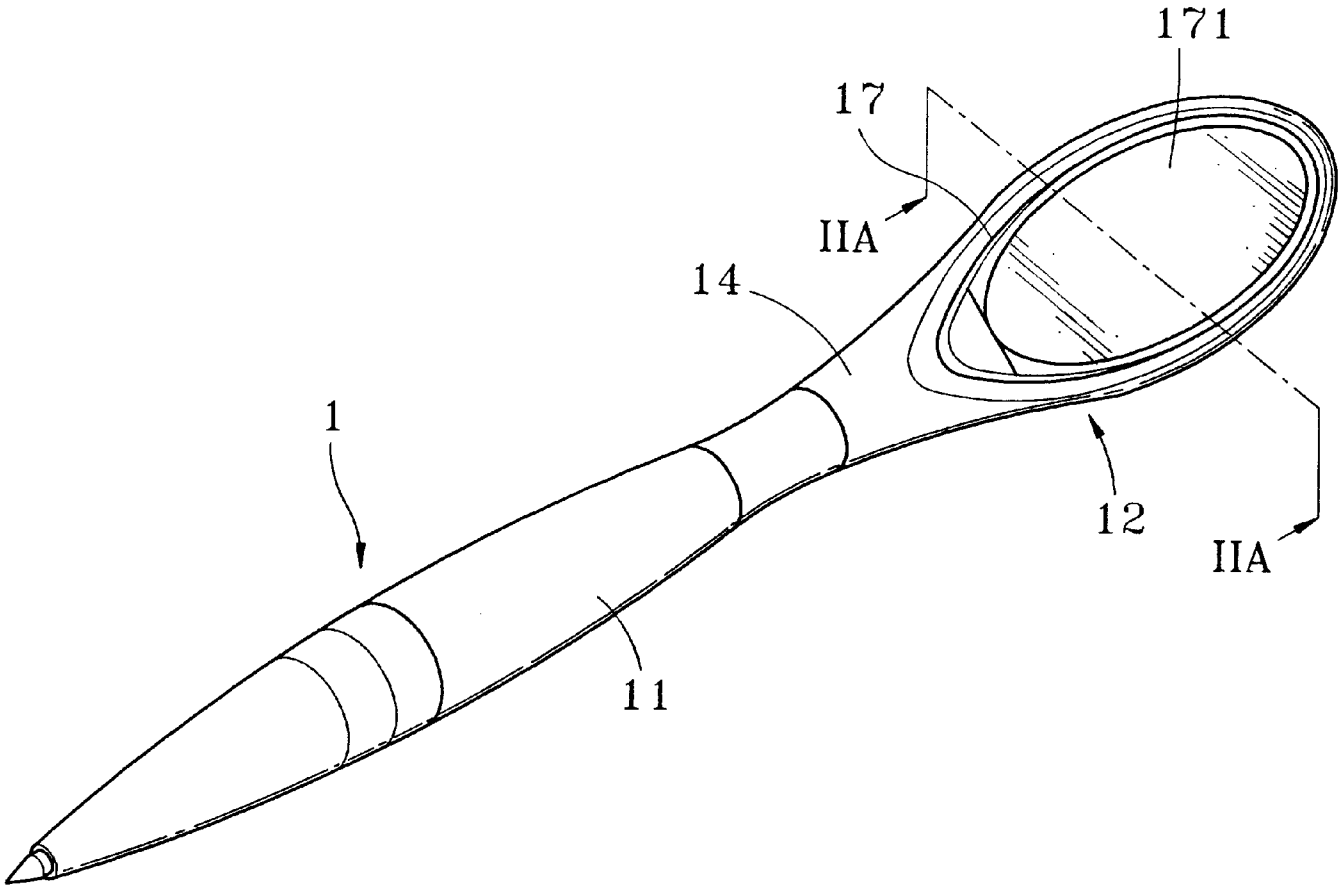
FIG. 1A illustrates a pen according to the present invention.
Figure 1B:
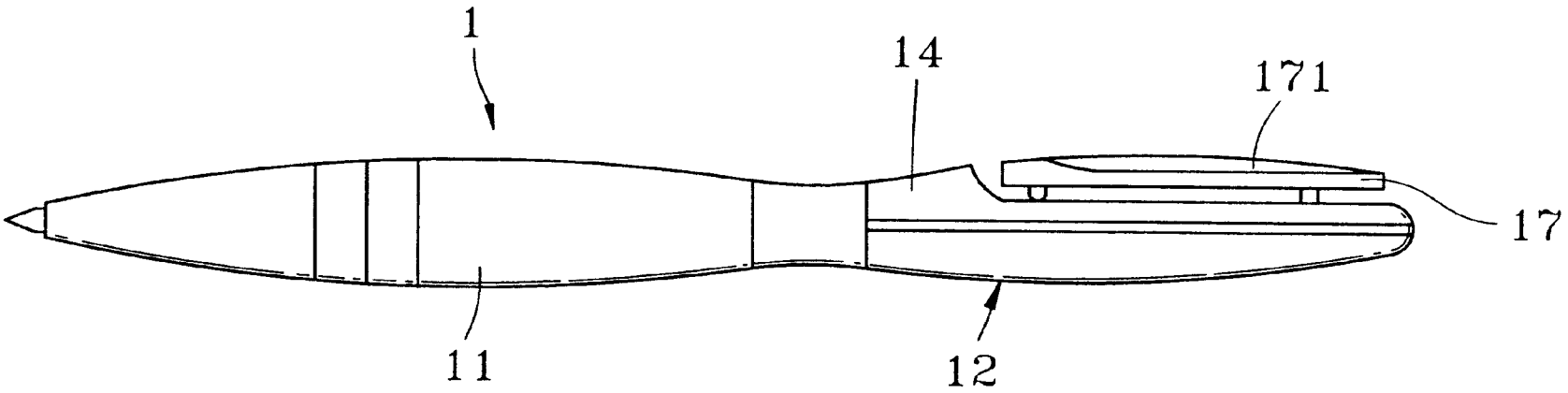
FIG. 1B is a side view of the pen shown in FIG. 1A.
Figure 1C:
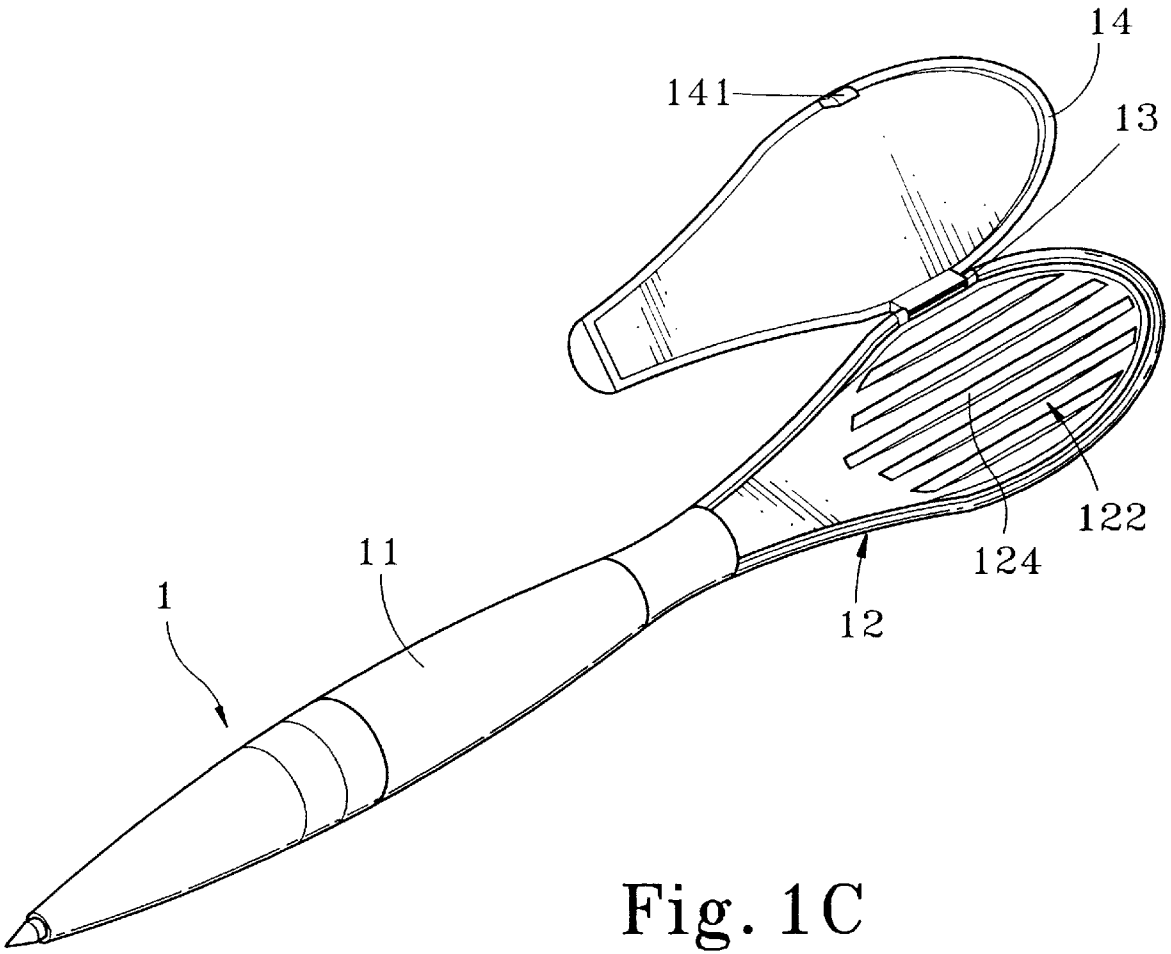
FIG. 1C illustrates the cover opened from the head member of the pen according to the present invention.

Referring to FIGS. 1A, 1B and 1C, a writing apparatus for example a pen 1 is shown comprised of a pen body 11, and a head member 12 connected to the pen body 11 at one end (namely, the top end remote from the writing tip).

Figure 4:
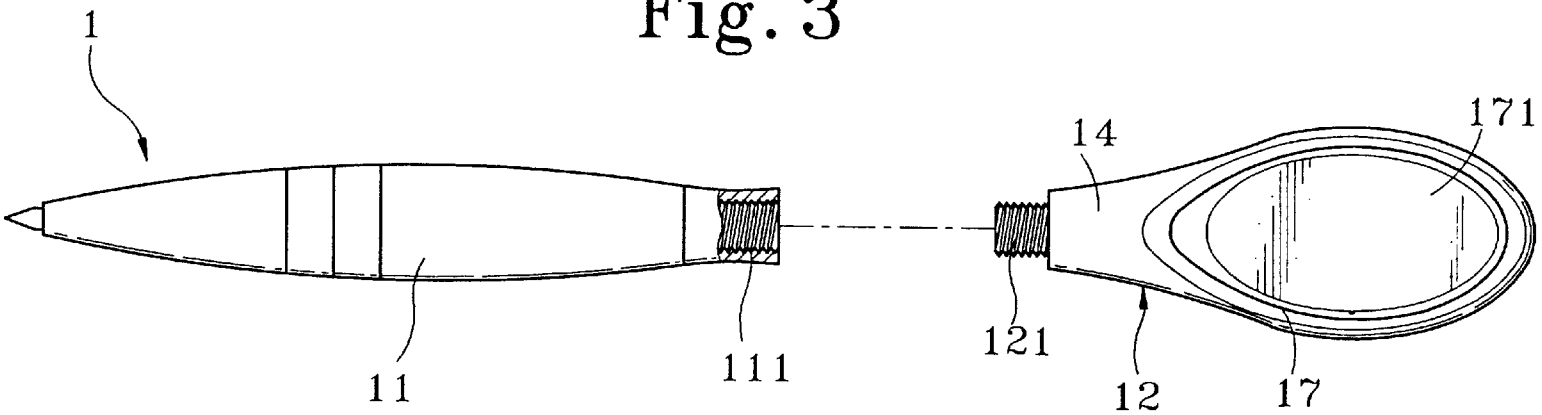
FIG. 4 illustrates the screw rod of the head member disconnected from the screw hole at the pen body according to the present invention.

Referring to FIG. 4 and FIG. 1A again, the pen body 11 has a female coupling means for example a screw hole 111 at one end, and the head member 12 has a male coupling means for example a screw rod 121 at one end, which is threaded into the screw hole 111 at the pen body 11, enabling the pen body 11 and the head member 12 to be connected together.

Figure 2A:
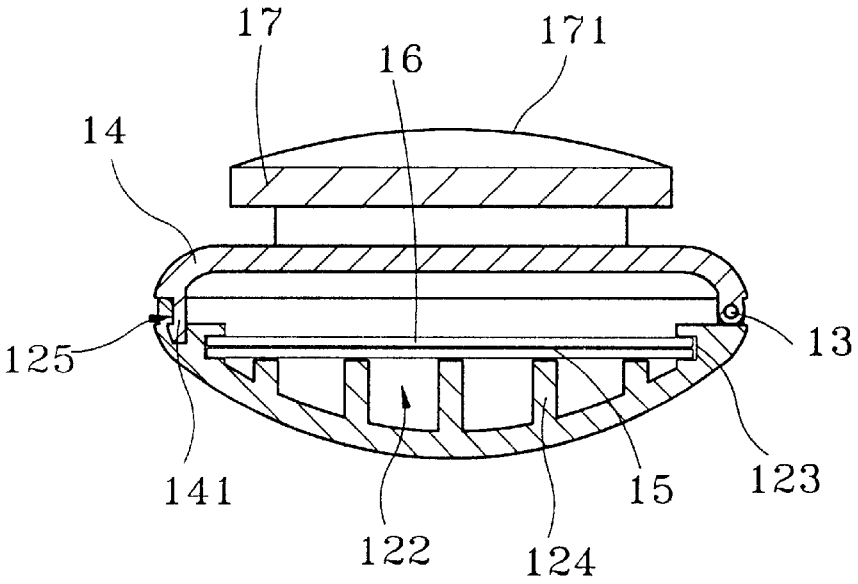
FIG. 2A is a sectional view taken along line IIA—IIA of FIG. 1A.
Figure 2B:
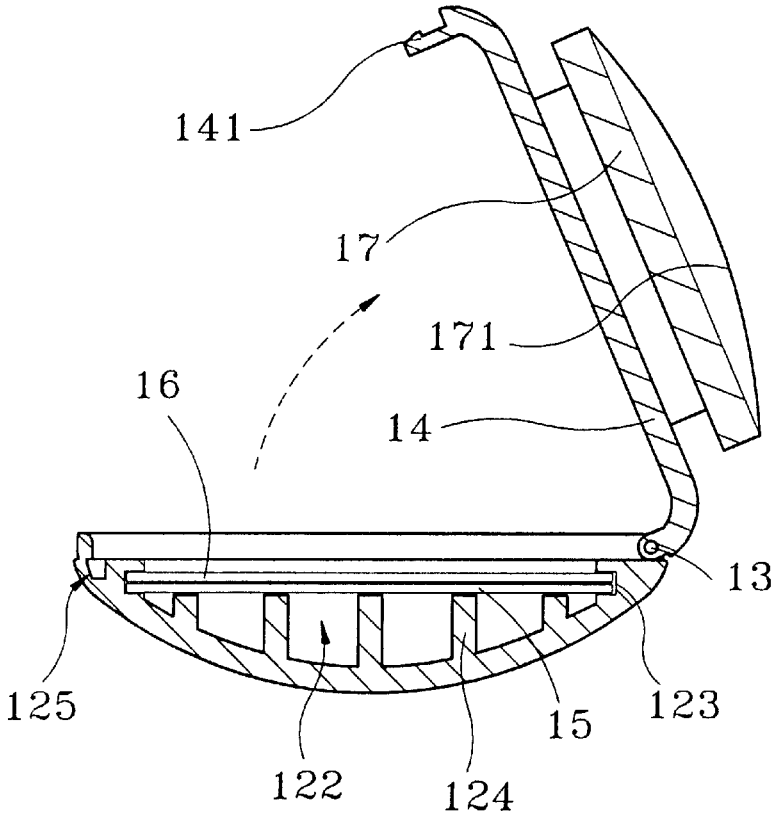
FIG. 2B is similar to FIG. 2A but showing the cover opened.

Referring to FIGS. 2A and 2B and FIGS. 1A, 1B, 1C and 4 again, the head member 12 comprises a recessed receiving chamber 122, a locating means for example a locating groove 123 on the inside around the recessed receiving chamber 122 for holding a flat item for example a picture (or mirror) 15 in the recessed receiving chamber 122 and a protective glass 16 above the picture 15, and a plurality of ribs 124 inside the recessed receiving chamber 122 for supporting the inserted item 15. Because the inserted picture 15 is retained between the ribs 124 and the glass 16, it is maintained in a flat manner and well protected.

A cover 14 is hinged to one lateral side of the head member 12 by hinge means 13, which can be a hinge or a flexible strip connected between the cover 14 and the head member 12, and covered on the head member 12 to keep the recessed receiving chamber 122 from sight. The head member 12 has a retaining hole 125 at one lateral side opposite to the hinge means 13. The cover 14 has a springy hook 141 at one lateral side. When the cover 14 is closed on the head member 12 as shown in FIG. 2A, the springy hook 141 is forced into engagement with the retaining hole 125 to hold the cover 14 in the closed position. When the cover 14 is opened (pulling the cover 14 with force can easily disengage the springy hook 141 from the retaining hole 125), the user can see the picture 15. If the inserted item is a mirror, the user can see oneself in the mirror when the cover 14 is opened.

Referring to FIGS. 1B, 2A and 2B again, a clip 17 is mounted on the cover 14 for fastening. The clip 17 can be integral with the cover 14. Alternatively, the clip 17 can be separately made, and then fixedly fastened to the cover 14. Further, an ornamental plate 171 is provided at the clip 17 at an outer side. The ornamental plate 171 can have any of a variety of designs. A stick with printed advertising words may be adhered to the ornamental plate 171.

Figure 3:
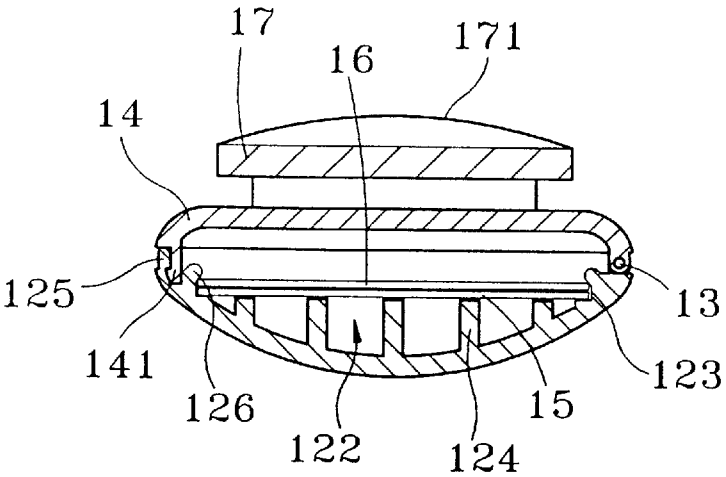
FIG. 3 is a sectional view of an alternate form of the present invention, showing a retaining flange provided in the recessed receiving chamber of the head member.

Referring to FIG. 3, a retaining flange 126 may be provided in the recessed receiving chamber 122 of the head member 12 to hold down the inserted item 15 and the protective glass 16 in the locating groove 123 within the recessed receiving chamber 122.

What is claimed is:

1. A pen comprising:

a pen body;

a head member connected to said pen body at one end, said head member comprising a recessed receiving chamber, and a locating groove for securing a display item in said recessed receiving chamber; and a cover covered on said head member to keep said recessed receiving chamber from sight, said cover having a first lateral side connected to a first lateral side of said head member and a second lateral side detachably secured to a second lateral side of said head member by lock means, said lock means comprising a retaining hole at the second lateral side of said head member and a spring hook at the second lateral side of said cover.

2. The pen of claim 1 wherein said head member is connected to said pen body by a joint.

3. The pen of claim 2 wherein said joint comprises a screw hole at one end of said pen body, and a screw rod at one end of said head member for threading into said screw hole.

4. The pen of claim 1 wherein the first lateral side of said cover is hinged to the first lateral side of said head member by hinge means.

5. The pen of claim 4 wherein said hinge means is a hinge.

6. The pen of claim 4 wherein said hinge means is a flexible strip connected between said cover and said head member.

7. The pen of claim 1 wherein said cover is mounted with a clip for fastening.

8. The pen of claim 7 wherein said clip comprises an ornamental plate at an outer side.

9. The pen of claim 1 wherein the locating groove for securing a display item in said recessed receiving chamber is inside said head member around said recessed receiving chamber.

10. The pen of claim 9 wherein said head member comprises a plurality of ribs inside said recessed receiving chamber for supporting an inserted display item in place.

11. The pen of claim 1 wherein said head member comprises a retaining flange on the inside around said recessed receiving chamber for holding down an inserted display item in said recessed receiving chamber.

12. The pen of claim 11 wherein said head member comprises a plurality of ribs inside said recessed receiving chamber for supporting an inserted display item in place.

* * * * *